United States Patent [19]

Müller

[11] 4,320,895

[45] Mar. 23, 1982

[54] RUNNING TRAINING APPARATUS

[76] Inventor: Simon Müller, Stationsstrasse, CH 8442 Hettlingen, Switzerland

[21] Appl. No.: 150,358

[22] Filed: May 16, 1980

[30] Foreign Application Priority Data

May 18, 1979 [CH] Switzerland ..... 4656/79

[51] Int. Cl.[3] ..... A63B 23/04

[52] U.S. Cl. ..... 272/70; 73/379; 73/DIG. 11; 272/76; 272/93; 272/DIG. 4; 272/DIG. 5

[58] Field of Search ..... 272/70, 73, 116, 125, 272/135, 136, 137, DIG. 4, DIG. 5, DIG. 6, 76, 93; 73/379, 380, 381, DIG. 11

[56] References Cited

U.S. PATENT DOCUMENTS

| | | | |
|---|---|---|---|
| 1,861,012 | 5/1932 | Hornbeck et al. | 73/379 |
| 2,309,511 | 1/1943 | Kellogg | 73/379 |
| 2,882,520 | 4/1959 | Hass | 73/DIG. 11 X |
| 3,107,818 | 10/1963 | Carmellini et al. | 73/DIG. 11 X |
| 3,336,805 | 8/1967 | Austin | 73/381 |
| 3,420,222 | 1/1969 | Noe et al. | 73/380 X |
| 3,795,396 | 3/1974 | Kropelnitski | 272/93 |
| 3,797,010 | 3/1974 | Adler et al. | 272/DIG. 5 X |
| 3,802,698 | 4/1974 | Burian et al. | 272/73 X |
| 3,822,599 | 7/1974 | Brentham | 272/DIG. 6 X |
| 4,099,713 | 7/1978 | Spector | 272/93 |
| 4,169,588 | 10/1979 | Miffitt et al. | 272/70 |
| 4,216,956 | 8/1980 | Yamamura et al. | 272/DIG. 5 X |

FOREIGN PATENT DOCUMENTS

| | | | |
|---|---|---|---|
| 380779 | 9/1923 | Fed. Rep. of Germany | 265/22 |
| 1350068 | 4/1974 | United Kingdom | 272/73 |

OTHER PUBLICATIONS

"Jogging Computer", Popular Science, Mar. 1978, p. 22.

*Primary Examiner*—Richard J. Apley
*Assistant Examiner*—Arnold W. Kramer
*Attorney, Agent, or Firm*—Karl F. Ross

[57] ABSTRACT

An apparatus for the training of athletes in running-type activities and especially for determining peak performance characteristics comprises a horizontal bar which responds to the leg movements of the athlete and is mounted on a pivotal bar running to a support. The latter is provided with a spring which bears upon the pivotal bar and the assembly comprises a switch device responsive to the movement of the actuatable bar for producing signals which are evaluated in an electronic evaluation unit. A fabric loop suspended from above the actuatable bar passes around the latter and can be changed readily for hygienic purposes.

8 Claims, 8 Drawing Figures

RUNNING TRAINING APPARATUS

FIELD OF THE INVENTION

The present invention relates to a training apparatus for athletes and the like.

BACKGROUND OF THE INVENTION

Various types of training apparatus are available for strengthening the leg muscles. They include, for example, rowing apparatus and bicycle-like home-training apparatus. For actual running training, there is an apparatus having a moving belt which is either driven by the muscle power of the person training, or is driven by a motor, whereby the person training can move freely. However, this apparatus is only suitable for fitness running training. Apparatus for training for, and measuring, peak performances is hitherto unknown.

OBJECTS OF THE INVENTION

It is an object of the present invention to provide a training apparatus by means of which momentary peak performances can be measured.

Yet another object of the invention is to provide a device which can respond to body movements of an athlete and especially leg movements for producing evaluatable signals indicative of peak performance over predetermined time spans.

Another object of my invention is to provide an apparatus cabable of evaluating peak performance and which is suitable not only for monitoring the activity of an athlete, but which is also capable of determining how the athlete can perform, especially with respect to leg movements, under loading during running and like movements.

SUMMARY OF THE INVENTION

According to the present invention a training apparatus comprises a mechanical sensing member and an electronic evaluation unit; the mechanical sensing member comprising an element which is movable by the leg movements of the person training and whose movements are converted into a signal, the signals being recorded in the evaluation unit.

According to a feature of the invention, the sensing member is a horizontal bar which can be actuated by the leg movements of a runner and which is spring-loaded into its lower position while being mounted on a pivotal arm connected to a support having a member overhanging this bar and from which a fabric loop is suspended, the loop passing around the bar and serving as a hygenic separation between the athlete and the bar according to a feature of the invention, the support is vertically adjustable upon a post and a spring bias is provided by a spring connected to the stationary arm and bearing upon the pivotal arm or bar via a roller, or a torsion spring between the pivotal bar and the support, or both.

According to yet another feature of this invention, the actuating bar carries a rod which reaches upwardly and is capable of interrupting a light beam in a photocell unit for producing signals to which the evaluation unit is responsive. In addition or alternatively, the deflectable horizontal bar within the fabric loop can be provided with an electromechanical switch.

The electronic evaluation unit can be provided with a microprocessor controller having an arithmetic unit (calculator) for totaling the count and/or arithmetically manipulating the same or calculating rates as may be desired, such microprocessor units being well known in the art.

The circuitry can also include a digital or numerical display for the count of the signals from the photocell unit, a clock which not only controls the microprocessor but enables the latter to act as a timer for predetermined intervals which can be set by a keyboard of switches likewise connected to the microprocessor.

BRIEF DESCRIPTION OF THE DRAWING

An embodiment of the invention is illustrated by way of example in the drawing, in which.

SPECIFIC DESCRIPTION

The training device embodying the invention comprises two separate parts: a mechanical sensing part 1 and an electronic evaluation unit 2. In priciple the two parts are determined only by their function and the embodiment illustrated is capable of being modified to a considerable extent.

Figure 1:
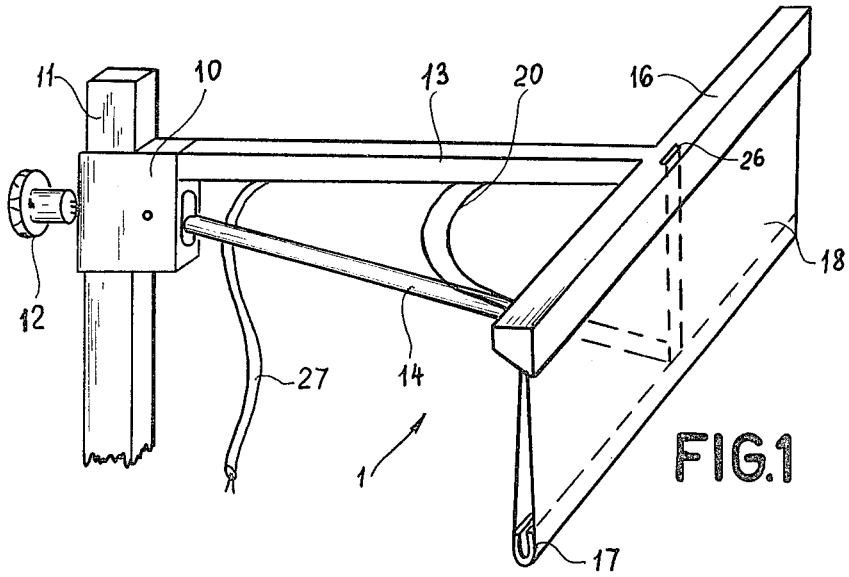
FIG. 1 is a perspective view of the mechanical sensing part of the apparatus.
Figure 2:
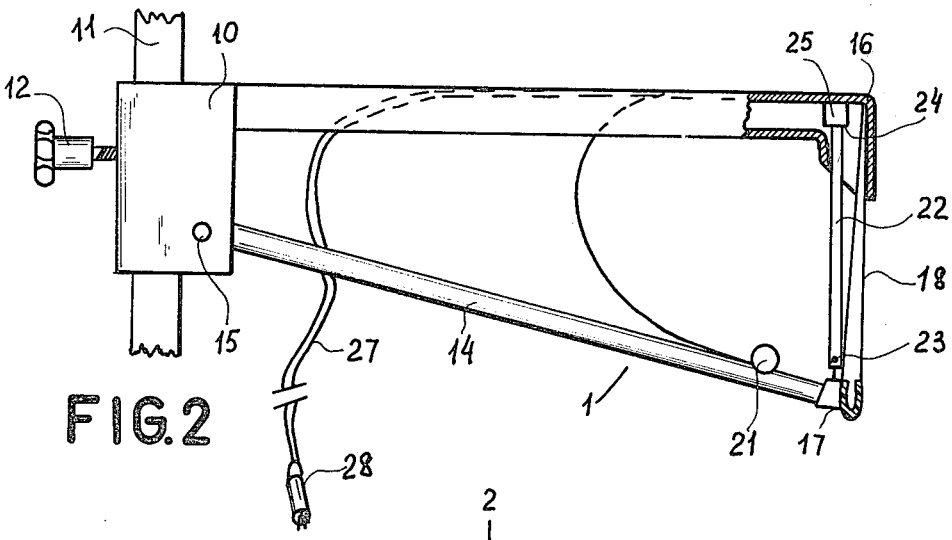
FIG. 2 is a partially sectioned side view of the same apparatus.
Figure 3:
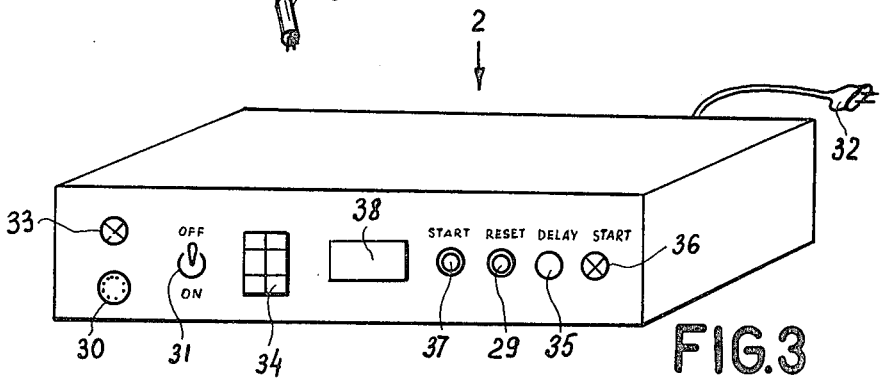
FIG. 3 shows the electronic evaluation unit of the running training device in accordance with the invention.

The sensing part 1 illustrated in FIGS. 1 and 2 has proved to be particularly advantageous. It comprises a holder 10 by means of which the part is securable to a post 11. This purpose is served particularly by the set screw 12 forming part of the holder 10. The sensing part 1 can be arranged at different heights on the post 11 by means of the set screw 12.

Two arms 13 and 14 are mounted on the holder 10. The arm 13 which is at the top in the operational position is rigidly connected to the holder 10, while the lower arm 14 is pivotally mounted in the holder 10. The imaginary vertex of the two arms 13 and 14 can be located within or, alternatively, at a short distance outside the holder 10. The pivot point of the arm 14 is designated 15. In the present instance the fixed arm 13 comprises a metal profiled bar of U-shaped cross section. A bar 16 is welded to the end of the arm 13 which is remote from the apex, the bar 16 being welded at right angles to the arm such that it extends horizontally when the sensing part is in its position for use. A sensing bar 17 is provided at the end of the arm 14 which is remote from the apex, and extends parallel to the bar 16. The sensing bar 17 comprises a rounded plastic bar.

A cloth 18, which is folded to form a loop, is releasably secured to the bar 16 along the two folded-together edges. For reasons of hygiene the cloth 18 should be relatively simple to remove to allow it to be changed. The sensing bar 17 is located in the fold of the cloth loop 18.

A spring 20 is secured at one end to the U-shaped profile of the arm 13, and a roller 21, secured to the other end of the spring rests on the bottom arm 14. The spring 20 is formed from two spring steel wires which partially form the axle for the roller 21.

A rod 22 is secured to the arm 14 by means of a hinge 23. The other end of the rod extends into a guide 24 formed in a photoelectric cell housing 25. A relatively small movement of the sensing bar 17 is sufficient for the rod to move and to interrupt the passage of light to the photoelectric cell and thus to trigger a counting pulse. In the case of excessive movements the rod 22 projects out of the slot 26 in the bar 16. The electrical signal is transmitted to the evaluation unit 2 by way of the cable 27 and the plug 28.

A socket 30 for the plug 28 is provided on the evaluation unit 2. When the unit has been connected to the supply voltage by way of the main plug 32, and switches on by means of the switch 31, a pilot lamp 33 lights up. The person training can then set a desired time in seconds by means of the preselector switches 34. However, since the person training is not able to fully concentrate on the running movement if he himself has to give the starting signal, a rotary switch 35 is provided so that the person training can allow himself an optional period of time after pressing the start button 37 before a start lamp 36 lights up. This lamp is green and denotes a starting signal. The button 37 first triggers the preselection and this in turn triggers the starting signal. The movements of the sensing bar 17, which is encountered by the legs, by the up and down leg movements of the runner, initiated by the person training result in switching pulses which are counted in the evaluation unit 2 and which are read from the display 38. The result can be erased by pressing cancel switch 39.

It will be appreciated that the valuation unit can also be provided with a computer if this is desired. Thus, average values can be ascertained and results can be stored or added. At the same time, the various times can be fed in by means of the keyboard 34.

Instead of or in addition to the spring 20, a torsion spring may be arranged in the region of the pivot within the holder 10.

An electromechanical switch may be mounted on the sensing member 17, the switch being operatively connected to the evaluation unit.

Figure 4:
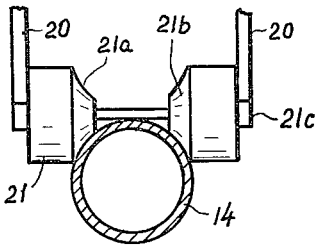
FIG. 4 is a cross section through the pivotal bar or arm showing the spring which bears thereon via a roller according to a feature of the invention.

As can be seen from FIG. 4, the spring wires 20 are connected at their lower ends to the axle 21*c* of a roller 21 formed by two roller halves which are contoured at 21*a* and 21*b* to be complementary to the external surface of the lower arm 14.

Figure 5:
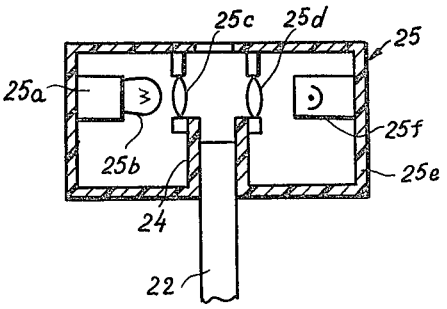
FIG. 5 is a diagrammatic cross section through the photocell unit used in the devices of FIGS. 1 and 2.

The photocell unit 25 comprises, as can be seen from FIG. 5, a housing 25*e* formed with the guide 24 for the rod 22 and a socket 25*a* for a lamp 25*b* which is energized by the source 51 when the evaluation unit is plugged in and the power switch 31 is operated.

A light beam is formed by conventional optics represented by the lens 25*c* and projects across the upper end of the rod 22 so that it can be interrupted by the upper end of this rod as the latter is lifted with the sensing bar 17. Opposite the optics 25, another lens 25*d* is provided to focus the uninterrupted beam into the photocell 25*f*. The output of this photocell serves as the signal from the photocell unit 25 to the microprocessor 52 (FIG. 6).

Figure 6:
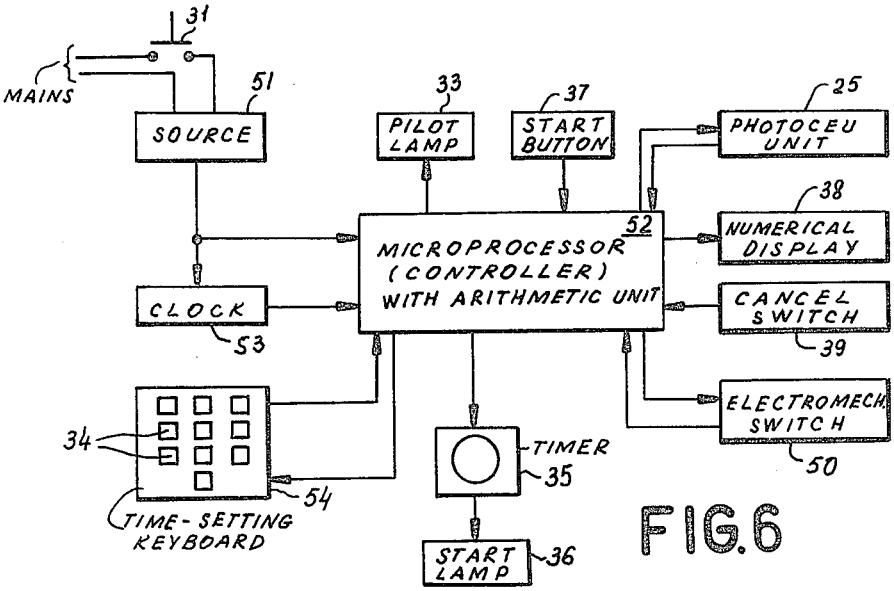
FIG. 6 is a block diagram illustrating parts of the evaluation unit.

As can be seen from FIG. 6, the evaluation unit can include a source 51 of low voltage direct current which can be connected to the mains by the plug 32 and the switch 31 as previously described, the source 51 feeding the microprocessor 52 and a clock pulse generator 53 which, in a conventional manner, is connected to the microprocessor.

Figure 7:
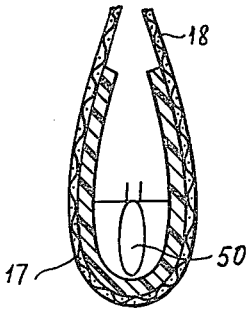
FIG. 7 is a cross section through the horizontal bar, also referred to as the sensing bar, showing the fabric loop therearound and an electrochemical switch which can provide an input to the evaluation unit.

The microprocessor is associated with a keyboard 54 provided with the time-set key display 38 and with the electromechanical switch 50 which can be provided as a mercury switch within the bar 17 as shown in FIG. 7. The remaining elements in FIG. 6 and their function have already been described.

Figure 8:
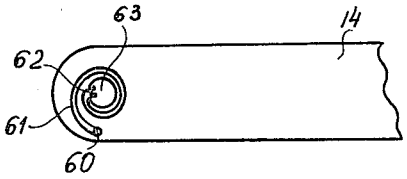
FIG. 8 is a diagrammatic elevational view showing another spring bias for the lower arm which may be used in conjunction with the spring system of FIG. 4 or as an alternative thereto.

FIG. 8 shows that the lower arm 14 can be connected to one end 60 of a torsion spring 61 whose other end 62 is connected to the pivot shaft 63 of the arm to swing the bar 14 downwardly and resist upward displacement. This torsion spring arrangement can be used in conjunction with or independently of the spring 20.

I claim:

1. A training apparatus for monitoring the performance of a runner, said apparatus comprising:

a mechanical sensing means engageable with legs of a runner and including an element movable by the leg movements of the runner;

means for converting movement of said element into a signal; and electronic evaluation means responsive to said signal for recording same, said mechanical sensing means comprising:

an upright post, a support shiftable along said post and provided with means for locking said support to said post at a selected height therealong, an upper first arm fixed to said support and projecting substantially horizontally therefrom, said upper arm having a free end spaced from said support, a lower second arm pivotally connected to said support, coplanar with said first arm and extending from said support codirectionally with said first arm, said lower arm being T-shaped and formed at a free end therof remote from said support with a horizontal cross member forming said element, and spring means interconnecting said arms proximal to the free ends thereof for resisting upward displacement of said lower arm upon engagement of the legs of the runner with said cross member.

2. The apparatus defined in claim 1 wherein the upper arm is also of T-shaped construction and provided with a cross member at its free end, said cross member of said upper arm being parallel to the cross member of said lower arm, said apparatus further comprising a cloth stretched between said cross members and limiting downward displacement of said lower arm.

3. The apparatus defined in claim 2, further comprising a rod secured to said lower arm and a photocell selectively shielded from light by said rod for generating said signal.

4. The apparatus defined in claim 1 wherein said spring means includes a bent spring fixed to said upper arm and bearing with a rolling member on said lower arm.

5. The apparatus defined in claim 1 wherein said spring means includes a torsion spring at a pivot between said lower arm and said support.

6. The apparatus defined in claim 1, further comprising a switch on said lower arm for generating said signal.

7. The apparatus defined in claim 1 wherein said electronic evaluation means has an adjustable timer for selecting the beginning and end of a measuring period, a counter with a digital display for counting pulses of said signal, and a lamp which is illuminated for the duration of the measuring period.

8. The apparatus defined in claim 7 wherein said evaluation means includes a time delay member for initiating said measuring period with a time lapse subsequent to a manually triggered starting signal.

* * * * *